US008543453B1

(12) United States Patent
Calvert et al.

(10) Patent No.: US 8,543,453 B1
(45) Date of Patent: Sep. 24, 2013

(54) PUBLICATION EVALUATION

(75) Inventors: Guy Calvert, Palo Alto, CA (US); Aaron Shon, Seattle, WA (US); Matthew C. Cary, Seattle, WA (US); Michael English, Seattle, WA (US); Michael Skinner, Seattle, WA (US); Courtney L. Bowman, San Francisco, CA (US)

(73) Assignee: Google Inc., Mountain View, CA (US)

( * ) Notice: Subject to any disclaimer, the term of this patent is extended or adjusted under 35 U.S.C. 154(b) by 589 days.

(21) Appl. No.: 12/437,705

(22) Filed: May 8, 2009

(51) Int. Cl.
*G06Q 30/00* (2012.01)

(52) U.S. Cl.
USPC ..... 705/14.43; 705/14.42; 705/14.41; 705/7

(58) Field of Classification Search
USPC ..... 705/14
See application file for complete search history.

(56) References Cited

U.S. PATENT DOCUMENTS

2005/0283354 A1* 12/2005 Ouimet ..... 703/26
2006/0004628 A1* 1/2006 Axe et al. ..... 705/14
2007/0239532 A1* 10/2007 Benson et al. ..... 705/14
2008/0059301 A1* 3/2008 Granville ..... 705/14
2008/0154717 A1* 6/2008 Saifee et al. ..... 705/14
2009/0106103 A1* 4/2009 Milana et al. ..... 705/14

OTHER PUBLICATIONS

U.S. Appl. No. 11/830,728, filed Jul. 30, 2007, Benson et al.

* cited by examiner

*Primary Examiner* — John G Weiss
*Assistant Examiner* — Eric Netzloff
(74) *Attorney, Agent, or Firm* — Fish & Richardson P.C.

(57) ABSTRACT

A publication evaluation subsystem generates publication scores for publications. Each publication score is indicative of an expected performance for content that is presented with the publication. The publication scores are generated relative to a baseline performance measure. The baseline performance measure has a value that is indicative of an expected performance of any selected content presented with any publication in the content network. More than one publication score can be generated for each publication, with each publication score being indicative of the performance of a sub-group of content items that are presented with the publication. The sub-group of content items can include content items that each share a common characteristic. For example, a publication score can be generated for a sub-group of content items that are associated with common targeting criteria (e.g., keywords).

20 Claims, 5 Drawing Sheets

PUBLICATION EVALUATION

BACKGROUND

This document relates to publication evaluation.

The Internet has enabled access to a wide variety of publications containing content, such as text, video and/or audio files related to particular subjects. Such access to these publications has likewise enabled opportunities for targeted advertising. For example, an advertiser can associate targeting keywords with the advertisement that represent the content of the advertisement. In turn, the advertisements can be presented with publications that are identified as having content that satisfies the targeting keyword, and therefore is related to the advertisement.

In some situations, targeting criteria for an advertisement can be satisfied by content that is not closely related to the content of the advertisement. For example, if an advertiser specifies a targeting keyword such as "sports" with an advertisement, the keyword may be satisfied by content that is related to any sport. If the advertisement is promoting football memorabilia, the performance of the advertisement may be significantly different when presented with content related to football relative to content related to other sports. Due to the possible wide variation in advertisement performance due to the publication with which the advertisement is presented, an advertiser may wish to pay less money for advertisements that are presented with a publication that provides lower levels of return than publications that provide higher levels of return.

SUMMARY

In general, one aspect of the subject matter described in this specification can be implemented in methods that include the actions accessing advertisement performance data for a plurality of advertisements, the advertisement performance data for each advertisement of the plurality of advertisements specifying a performance measure for the advertisement; generating a baseline performance measure for a plurality of publications based on the performance data, the baseline performance measure being publication independent; for one or more of the plurality of publications: accessing publication data that includes performance measures for each advertisement presented with the publication; and generating a publication score based on the baseline performance measure and the publication data. Other implementations of this aspect include corresponding systems, apparatus, and computer program products.

These and other implementations can optionally include one or more of the following features. The methods can include one or more of the actions adjusting a price paid for presentation of an advertisement with a publication based on the publication score for the publication; identifying one or more advertisement sets for a publication, each advertisement set including one or more advertisements that each have a common characteristic; for each advertisement set: generating an advertisement set publication score based on the performance data for advertisements in the advertisement set and an advertisement set baseline performance measure; adjusting a price paid for presentation of an advertisement in the advertisement set based on the advertisement set publication score generating a dispersion score for each advertisement set, the dispersion score representing a variance of advertisement performance relative to the advertisement set publication score; determining whether the dispersion score satisfies a dispersion score threshold; and wherein the adjusting is conditioned on the dispersion score satisfying a dispersion score threshold determining whether a stop condition has been satisfied; and wherein identification of one or more advertisement sets is conditioned on the stop condition not being satisfied.

The baseline performance measure can be generated by the actions initializing the baseline performance measure to a default value; for each advertisement, generating an advertisement performance measure for the advertisement based on a performance of the advertisement in response to presentation of the advertisement with the publication relative to the baseline performance measure; and adjusting the baseline performance measure based on the advertisement performance measures; determining whether a convergence condition has been satisfied; and in response to the convergence condition not being satisfied, iteratively generating the advertisement performance measures and the baseline performance measure until the convergence condition is satisfied. The baseline performance can be defined as valid when the convergence condition is satisfied.

The publication score can be generated by the actions generating publication performance measures for the publication based on the publication data for each advertisement presented with the publication relative to the baseline performance measure; and generating a publication score for the publication based on the publication performance measures, the publication score being indicative of an aggregate of the publication performance measures relative to the baseline performance measure.

Particular implementations may realize one or more of the following advantages. For example, a baseline publication score can be generated that is independent of any particular publication such that publication scores can be generated for any publication. Advertisement set publication scores can be generated to provide a publication score for a subset of advertisements that are presented with the publication. The prices paid by advertisers for presentation of advertisements can be adjusted by the publication scores to provide a more consistent return on investment for the advertiser across publications.

The details of one or more implementations are set forth in the accompanying drawings and the description below. Other features and advantages will be apparent from the description and drawings, and from the claims.

DESCRIPTION OF DRAWINGS

Like reference symbols in the various drawings indicate like elements.

DETAILED DESCRIPTION

Figure 1:
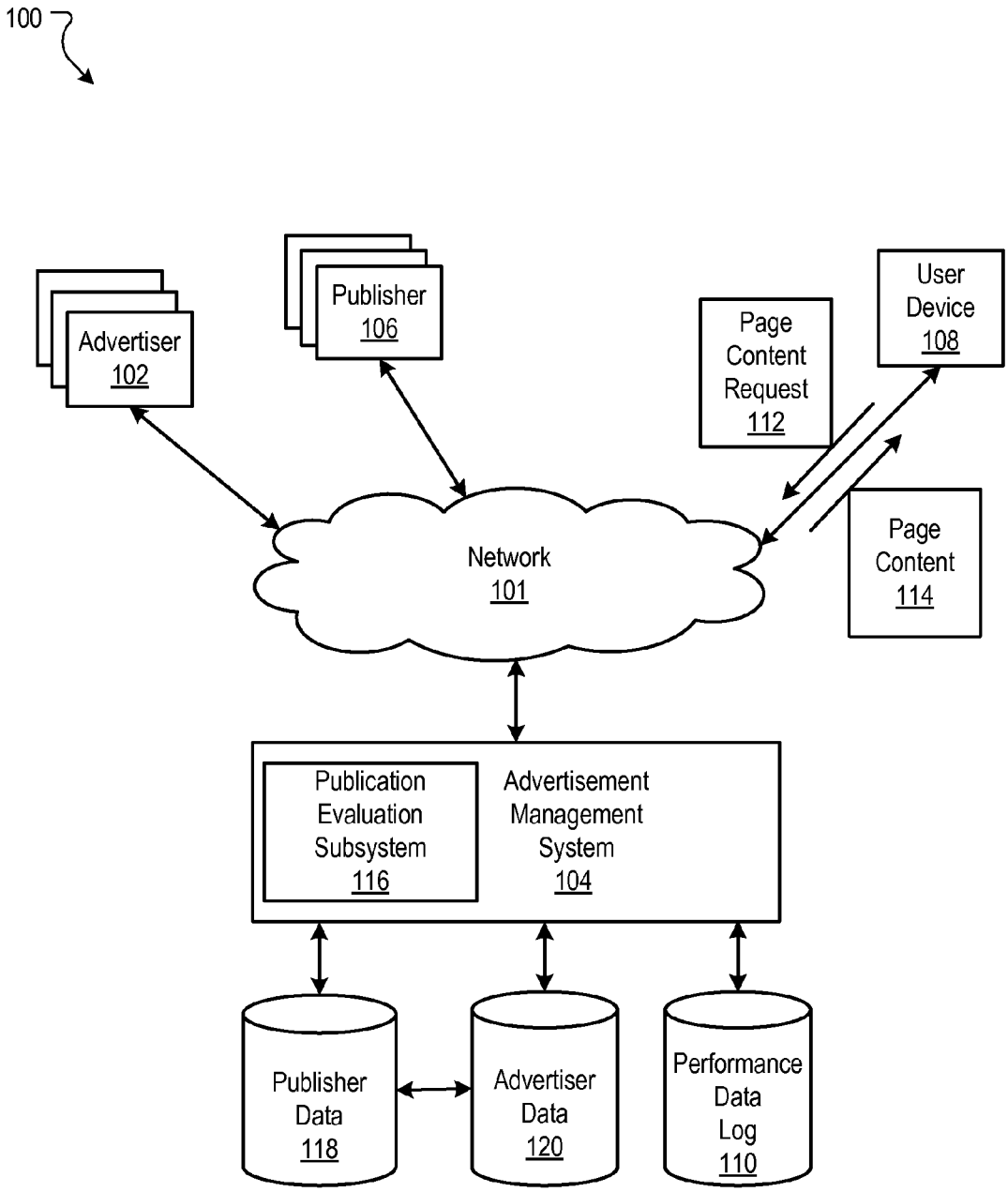
FIG. 1 is a block diagram of an example online environment.

A publication evaluation subsystem generates publication scores for publications. Each publication score is indicative of an expected performance for content that is presented in conjunction with the publication. The publication scores are generated relative to a baseline performance measure. The baseline performance measure has a value that is indicative of an expected performance of any selected content presented with any publication in the content network.

In some implementations, the baseline performance measure is generated based on performance measures of content items that are each presented with multiple publications. The performance measures for a content item can be a number of times that an action is taken by a user when the content item is presented with the publication. For example, a number of conversions (e.g., sales transactions) that occur in response to the advertisement being presented with web pages can be defined as a performance measure for the advertisement.

The publication evaluation subsystem generates a publication score for a particular publication based on publication performance measures for the publication. The publication performance measures are performance measures for content items presented with the particular publication relative to the baseline performance measure. The publication score is indicative of an aggregate of the publication performance measures. For example, if content items perform better than the baseline performance measure when presented with the publication, a publication score indicative of the increased performance can be generated for the publication.

The publication scores can be used to adjust prices paid by content providers that provide content for presentation with the publication. For example, a price an advertiser bids or pays for presentation of an advertisement with the publication can be scaled by the publication score.

In some implementations, more than one publication score can be generated for each publication. Each publication score can be indicative of the performance of a sub-group of content items that are presented with the publication. The sub-group of content items can include content items that each share a common characteristic. For example, a publication score can be generated for a sub-group of content items that are associated with common targeting criteria (e.g., keywords).

Example publication evaluation devices, systems and processes are described below in the context of an online environment. Therefore, the example publications are described as web pages and the example content items are described as advertisements. However, an online environment is only one of many environments in which the devices, systems, and processes discussed below can be implemented. For example, the description below can be equally applied to printed publications, broadcast media (e.g., satellite, cable, television and/or radio) and outdoor advertising environments as well as other publications.

FIG. 1 is a block diagram of an example online environment 100. The online environment 100 can facilitate the identification and serving of content items, such as web pages and advertisements, to users. A computer network 101, such as a local area network (LAN), wide area network (WAN), the Internet, or a combination thereof, connects advertisers 102, an advertisement management system 104, publishers 106 and user devices 108. The online environment 100 may include many thousands of advertisers 102, publishers 106 and user devices 108.

In some implementations, one or more advertisers 102 can directly, or indirectly, enter, maintain, and track advertisement information in the advertising management system 104. The advertisement information can include advertisements that the advertiser 102 has provided for presentation on publisher web pages. The advertisements can be in the form of graphical advertisements, such as banner advertisements, text only advertisements, image advertisements, audio advertisements, video advertisements, advertisements combining one of more of any of such components, or any other type of electronic advertisement document. The advertisements may also include embedded information, such as links, meta-information, and/or machine executable instructions, such as HTML or JavaScript™. The advertisement information, corresponding advertisements and other advertisement data can be stored in an advertiser data store 120 that is coupled to the advertisement management system 104.

A user device 108 can submit a page content request 112 to a publisher 106. In some implementations, page content 114 can be provided to the user device 108 in response to the page content request 112. The page content 114 can include advertisements provided by the advertisement management system 104, or can include executable instructions, e.g., JavaScript™, that can be executed at the user device 108 to request advertisements from the advertisement management system 104. Example user devices 108 include personal computers, mobile communication devices, and television set-top boxes.

Requests for advertisements can also be received from the publishers 106. For example, one or more publishers 106 can submit advertisement requests for one or more advertisements to the advertisement management system 104. The system 104 responds by sending the advertisements to the requesting publisher 106 for placement in an advertisement slot that is presented on one or more of the publisher's web properties (e.g., websites and other network-distributed content).

Advertisers can target presentation of advertisements by providing advertisement targeting data that specifies criteria that a publisher's web property should satisfy for the advertisement to be presented with the web property. Two types of targeting for which an advertiser can specify targeting criteria are site-based targeting and content-based targeting. Site-based targeting enables advertisers to specify particular web pages or websites (e.g., a collection of web pages) with which the advertisement may be presented. For example, an advertiser may specify that its advertisements can be presented on a web page that is associated with the uniform resource locator http://www.example.com. Therefore, the advertisement management system 104 can select the advertiser's advertisements for presentation when advertisements are requested for presentation with the web page.

Content-based targeting enables advertisers to specify content that a publisher's web property should include for an advertisement to be presented with the web property. For example, advertisers can specify keyword criteria that can condition presentation of the advertisement on satisfaction of one or more particular keyword criteria by content associated with a web page. Thus, when an advertiser conditions presentation of its advertisement on the satisfaction of a specified keyword criterion, the advertisement management system 104 will select the advertiser's advertisement for presentation with web pages that include content that satisfies the keyword criterion.

For example, an advertiser can submit the keyword "tennis" to the advertisement management system 104 to be associated with an advertisement for tennis apparel. Based on submission of this keyword, the advertisement management system 104 will present the advertisement with a web page that includes content that satisfies the "tennis" keyword criterion. The keyword criterion can be satisfied, for example, by the presence of the term "tennis" or by the presence of words related to tennis (e.g., "Wimbledon" or "U.S. Open") in text associated with the web page.

The advertisements provided with the publishers' properties can include embedded links to landing pages (e.g., pages on websites of the advertisers 102) that a user device 108 is directed to when a user selects an advertisement that is presented on the publisher's web property. The requests for advertisements can also include content request information. This content request information can include the content itself (e.g., a page or other content document) as well as, for example, a category corresponding to the content or the content request (e.g., arts, business, computers, arts-movies, and arts-music), part or all of the content request, content age, content type (e.g., text, graphics, video, audio, and mixed media) or geo-location information.

In some implementations, a publisher 106 can combine the requested content with one or more of the advertisements provided by the advertisement management system 104. This combination of requested content and advertisements can be sent to the user device 108 that requested the content as page content 114 for presentation in a viewer (e.g., a browser or other content display system). The publisher 106 can transmit information about the advertisements back to the advertisement management system 104, including information describing how, when, and/or where the advertisements are to be rendered (e.g., in HTML or JavaScript™).

Publishers 106 can include general content servers that receive requests for content (e.g., articles, discussion threads, music, video, graphics, search results, webpage listings and information feeds), and retrieve the requested content in response to the request. For example, content servers related to news content providers, retailers, independent blogs, social network sites, or any other entity that provides content over the network 101 can be a publisher 106.

The advertisers 102, user devices 108, and/or publishers 106 can provide usage information to the advertisement management system 104. This usage information can include measured or observed user behavior related to advertisements that have been served, such as, for example, whether or not a conversion or a selection related to an advertisement has occurred. The advertisement management system 104 performs financial transactions, such as crediting the publishers 106 and charging the advertisers 102 based on the usage information. Such usage information can also be processed to measure performance metrics, such as an impression count, a click-through-rate ("CTR") or a conversion rate. The usage data can be stored, for example in a performance data log 110.

An impression occurs when an advertisement is presented to a user. An impression count tracks the number of times that an advertisement has been presented to a user. For example, when a user device 108 requests a webpage, multiple advertisements can be provided to the user device 108 with the webpage. Each of the advertisements that are provided with the webpage can have an impression counter incremented because an advertisement impression has occurred.

A click-through can occur, for example, when a user of a user device 108, selects or "clicks" on a link to a content item returned by the publisher 106 or the advertising management system 104. The CTR is a performance metric that is obtained by dividing the number of users that clicked on the content item, e.g., a link to a landing page, an advertisement, or a search result, by the number of times the content item was delivered to user devices 108.

A "conversion" occurs when a user consummates a transaction related to a previously served advertisement. What constitutes a conversion may vary from case to case and can be determined in a variety of ways. For example, a conversion may occur when a user clicks on an advertisement, is referred to the advertiser's webpage, and consummates a purchase there before leaving that webpage. Other actions that constitute a conversion can also be used.

In some implementations, the advertisement management system 104 includes a publication evaluation subsystem 116 that can evaluate a quality of a publication. The publication evaluation subsystem 116 can evaluate the quality of a publication based on a performance measure of advertisements that are presented with the publication. For example, the quality of a publication can be based on a conversion rate (e.g., a number of conversions for an advertisement relative to a number of selections of the advertisement) for advertisements presented with the publication relative to an expected conversion rate for advertisements irrespective of the property with which an advertisement is presented.

The quality of the publication can be expressed as a publication score. The magnitude of the publication score can be indicative of how well advertisements presented with the publication perform relative to an expected performance measure. For example, a publication score greater than one (e.g., 1.2) can be indicative of a publication for which the performance measures for advertisements are higher than a baseline performance measure. A publication score less than one (e.g., 0.8) can be indicative of a publication for which the performance measures for advertisements are lower than the baseline performance measure.

The baseline performance measure can be determined based on the performance of advertisements when presented with a common known publication. When a statistically relevant number of advertisements are each presented with a common known publication (e.g., a publication other than the publication being evaluated), an average performance of the advertisements when presented with the common known publication can be defined as the baseline performance measure. For example, a group of advertisements that are presented with the site http://www.example.com may have a click-weighted average conversion rate of 0.1 conversions/click (i.e., 1 conversion for every 10 user selections of the advertisement). This average conversion rate can be defined as the baseline performance measure for the group of advertisements.

An average performance of the group of advertisements when presented with another publication can be compared to the baseline performance to generate a publication score for the other publication. The publication score for the other publication can be the average performance of the group of advertisements on the publication relative to the baseline average performance of the group of advertisements on the common known publication (i.e., $(\text{conversions/click})_{publication}/(\text{conversions/click})_{baseline}$). In this example, if the group of advertisements has a click-weighted average conversion rate of 0.11 clicks/conversion when presented with another publication, the publication score for the other publication can be 0.11/0.10, or 1.1, indicating that advertisements presented with the other publication perform 10% better than advertisements presented with the common known publication.

While publication performance can be evaluated relative to a baseline performance of a known publication, the number of advertisements that appear on a common known publication may decrease as the number of advertisers that use content-based targeting increases. For example, as the number of advertisers that enroll in "content only" advertising campaigns (e.g., targeting advertisements using only content-based targeting criteria rather than site-based targeting criteria) increases, the number of advertisers for which performance measures relative to a common known publication may be determined decreases. Therefore, identification of a common known publication that can be used for determining a baseline advertisement performance may become increasingly difficult.

In some implementations, the publication evaluation subsystem 116 can generate a baseline performance measure that is publication independent (i.e., not dependent on a common known publication). The publication evaluation system 116 generates the baseline performance measure by generating an expected performance of advertisements irrespective of the publication with which the advertisement is presented. This baseline performance measure can be generated, for example, based on an aggregate performance of advertisements presented with publications in the content network, with a performance measure representing this aggregate performance being defined as the baseline performance measure.

The aggregate performance of advertisements can be determined based on advertisement performance data for each of a set of advertisements. The advertisement performance data for each advertisement can be accessed, for example, in the performance data log 110.

The advertisement performance data for each advertisement specifies a performance measure for the advertisement when the advertisement is presented with various publications. For example, the advertisement performance data for an advertisement can specify a number of conversions relative to a number of selections (e.g., clicks) received by the advertisement. The advertisement performance data can specify a separate performance measure for the advertisement for each publication with which the advertisement is presented.

In some implementations, the aggregate performance of the advertisements and, in turn, the baseline performance measure of publications can be determined by iteratively determining a maximum likelihood estimate of advertisement performance based on the performance data. For example, the publication evaluation subsystem 116 can initialize the baseline performance measure to a default value. The default value can be, for example, a statistical measure (e.g., mean or median) of the performance measure for the advertisements.

Using the initialized baseline performance measure as the baseline performance measure for publications in the content network, the publication evaluation subsystem 116 can generate "adscores" for each of the plurality of advertisements. Each adscore is a measure of how well the advertisement performs relative to other advertisements. For example, the adscore for an advertisement that has a performance measure that is 50% of the baseline performance measure can be assigned an adscore of 0.5. Thus, comparing each advertisement's performance to the baseline performance measure enables the performance of each advertisement to be compared to the performance of other advertisements.

The adscores for each advertisement can be, for example, a maximum likelihood estimate of performance for the advertisement relative to the baseline performance. The maximum likelihood estimate can be determined, for example, as the log likelihood of a conversion for the advertisement using the initialized baseline performance as the expected conversion rate for any advertisement presented with any publication.

In some implementations, the publication evaluation subsystem 116 adjusts the baseline performance measure based on the adscores generated for each of the advertisements. For example, a maximum likelihood estimate of the baseline performance can be generated based on the adscores. The maximum likelihood estimate of the baseline performance provides the most likely performance measure of any given publication given the adscores of the advertisements.

The publication evaluation subsystem 116 can iteratively generate new adscores for the advertisements and adjust the baseline performance measure based on the newly generated adscores, in a manner similar to that described above. In some implementations, the publication evaluation subsystem 116 can end the iterative determination of adscores and adjustment of the baseline performance measure when a convergence condition has been satisfied for the baseline performance measure. The convergence condition can be, for example, the point at which the difference between the output baseline performance measure and the input baseline performance measure is less than a threshold difference.

The publication evaluation system 116 generates a publication score for a particular publication based on adscores of advertisements presented with the particular publication relative to the baseline performance. For example, the publication evaluation system 116 can generate a maximum likelihood estimate of performance for advertisements presented with the particular publication based on the performance of each advertisement when presented with the publication relative to the baseline performance measure. In some implementations, the maximum likelihood estimate of performance for advertisements presented with a particular publication can be determined according to equation (1):

$$\text{Score}_{Pub} = \frac{\text{Conversions}_{Pub}}{AdScores \cdot \text{Clicks}_{Pub}} \tag{1}$$

where, $\text{Score}_{Pub}$ is the publication score for a publication;

$\text{Conversions}_{Pub}$ is a number of conversions for advertisements that have been presented with the publication;

$\text{Clicks}_{Pub}$ is a number of clicks or selections for advertisements that have been presented with the publication;

AdScores is a vector of the adscores for the advertisements presented with the publication; and AdScores●$\text{Clicks}_{Pub}$ is a dot product of the vector of adscores for the advertisements and the clicks for advertisements presented with the publication.

Thus, as demonstrated by equation 1, the publication evaluation subsystem 116 can generate publication scores for publications irrespective of whether the advertisements presented with the publication are also presented with a common known publication.

Publication scores that are generated for publications using equation (1) can be used to update adscores for advertisements appearing on the publications. For example, the publication evaluation system 116 can generate a maximum likelihood estimate of advertisement performance based on the performance of the advertisement when presented with each of the publications. In some implementations, the adscores for advertisements can be determined according to equation (2):

$$AdScore_{Ad} = \frac{\text{Conversions}_{Ad}}{PubScores \cdot \text{Clicks}_{Ad}} \tag{2}$$

where, $\text{AdScore}_{Ad}$ represents the adscore for a particular advertisement;

$\text{Conversions}_{Ad}$ is a number of conversions for the advertisement when presented with publications;

$\text{Clicks}_{Ad}$ is a number of clicks or selections for the advertisement when presented with publications;

PubScores is a vector of the publication scores for the publications with which the advertisement was presented; and AdScores●$Clicks_{Ad}$ is a dot product of the vector of publication scores and clicks for the advertisement when presented with the publications.

An updated adscore can be generated for each advertisement that was presented with publications for which pubscores were generated using equation (1). The publication evaluation subsystem 116 can then use the updated adscores as the vector of adscores in equation (1) to generate updated pubscores for publications. Updated adscores and pubscores can be iteratively generated for the advertisements and publications, as described above. In some implementations, the publication evaluation subsystem 116 can end the iterative determination of adscores and pubscores when a convergence condition has been satisfied for the adscores and pubscores. The convergence condition can be, for example, the point at which the difference between output and input adscores and/or pubscores is less than a threshold difference.

In some implementations, an advertisement set publication score can be generated for each advertisement set that is presented with the publication. As used throughout this document, an advertisement set is one or more advertisements that each has a common characteristic. For example, a particular advertisement set can include advertisements that are each associated with the targeting keyword "football" or include content related to football. Similarly, advertisements that are each presented in a common language (e.g., French) can be included in an advertisement set for French language advertisements.

The publication evaluation subsystem 116 can identify advertisement sets for publications based on information provided by the advertiser. For example, an advertiser may provide information identifying a language of the advertisement, targeting criteria for the advertisement, or other characteristics associated with the advertisement.

Similarly, an advertisement set for a publication can be identified from content of the advertisements that are presented with the publication. For example, the content of advertisements presented with the publication can be examined to determine a language of text in the advertisement. Similarly, words in the advertisements can be analyzed to determine the subject matter to which the advertisement is related. For example, if the word "football" is identified in an advertisement, the advertisement may be grouped in an advertisement set for advertisements related to sports or football.

Each advertisement set publication score corresponding to each advertisement set is indicative of an expected performance for advertisements in the advertisement set when presented with the publication. The advertisement set publication score for each advertisement set is generated based on the performance data for the advertisements in the advertisement set and an advertisement set baseline performance.

The advertisement set baseline performance measure can be generated in a manner similar to that discussed above with respect to generation of a baseline performance measure. For example, iterative maximum likelihood estimates of adscores for the advertisements in the advertisement set and the advertisement set baseline performance can be determined based on performance measures of the advertisements and an initialized advertisement set baseline performance.

Similarly, the advertisement set publication score can be generated in a manner similar to that discussed above with respect to generation of a publication scores (e.g., with reference to equations (1) and (2)). For example, a maximum likelihood estimate of a performance measure for the advertisements in the advertisement set when presented with the publication can be based on the adscores of the advertisements in the advertisement set and the advertisement set baseline performance measure. In turn, publication scores and adscores for the advertisement set can be iteratively computed using equations (1) and (2).

Each advertisement set publication score for a publication may differ from the publication score for the publication because the advertisement set publication score considers the aggregate performance of advertisements in the advertisement set relative to the baseline performance measure rather than the aggregate performance of all advertisements presented with the publication.

For example, an advertisement set containing advertisements associated with the keyword "football" may have a higher aggregate performance when presented with a football-related publication than the aggregate performance of all advertisements presented with the publication. Therefore, the publication can be identified as a higher quality publication for advertisements in the "football" advertisement set and, in turn, have a "football" advertisement set publication score that is higher than its overall publication score.

Because advertisements can be associated with any number of different targeting criteria, each advertisement can be included in any number of different advertisement sets. For example, an advertisement may be associated with targeting keywords sports, football and college football such that the advertisement may be included in an advertisement set corresponding to each targeting keyword. Accordingly, each publication can be associated with advertisement set scores for each advertisement set with which the publication is presented.

When an advertisement is associated with more than one advertisement set, the advertisement set publication score having a highest magnitude can be applied to a bid amount received and/or price paid for the advertisement. Alternatively, the advertisement set publication score for the advertisement set having the lowest dispersion score (as discussed below) can be applied to the bid received and/or price paid for the advertisement.

In some implementations, the publication evaluation subsystem 116 assigns an advertisement set publication score to a publication for only a subset of the advertisement sets with which the publication is presented. The publication evaluation subsystem 116 can determine whether to assign an advertisement set publication score for an advertisement set based on a performance variance measure for the advertisement set relative to the performance variance measure for all advertisements presented with the publication.

In some implementations, the publication evaluation subsystem 116 uses a dispersion score as a performance variance measure. The dispersion score is a measure of how well advertisements perform relative to the publication score and/or advertisement set publication score with which the advertisements are associated. A dispersion score for an advertisement set can be determined based on a function of a difference between actual advertisement set performance and expected advertisement set performance.

In some implementations, the dispersion score for an advertisement set is based on performance variances of advertisements in the advertisement set relative to a mean performance of the advertisements in the advertisement set. For example, the dispersion score for an advertisement set can be determined according to equation (3):

$$\text{Dispersion}_{AdSet} = \frac{\sum_{i=1}^{AdNum_{AdSet}} [(\text{Conversion/Clicks})_{Adi} - (\text{Conversions/Clicks})_{AdSet}]}{AdNum_{AdSet}} \quad (3)$$

where, $\text{Dispersion}_{AdSet}$ represents the dispersion for an advertisement set;

$\text{AdNum}_{AdSet}$ is a number of advertisements in the advertisements set;

$\text{Conversion/Clicks}_{Adi}$ is a ratio of conversions to clicks for an advertisement in the advertisement set; and $\text{Conversion/Clicks}_{AdSet}$ is a mean ratio of conversions to clicks for the advertisements in the advertisement set.

In other implementations, the dispersion score for an advertisement set can be generated based on a sum of differences between the performances of the advertisements when presented with the publication relative to the advertisement set publication score. Therefore, the lower the dispersion score for an advertisement set, the more uniform the performance of advertisements in the advertisement set relative to the baseline advertisement set performance.

For example, a dispersion score for an advertisement set containing three advertisements A, B and C that are presented with a particular publication can be generated as provided in the following example. The publication evaluation subsystem 116 accesses performance data for advertisements and determines, for example, that the relative conversion/click ratios (i.e., $(\text{conversions/click}_{publication})/(\text{conversions/click}_{baseline})$ for advertisements A, B and C are 0.2, 0.5 and 0.3, respectively. The publication evaluation subsystem 116 sums the differences between each of the relative conversion/click ratios and the advertisement set publication score. For example, assuming that the advertisement set publication score is 0.33 (i.e., (0.2+0.3+0.5)/3), the sum of the differences is 0.33 (i.e., 0.13+0.17+0.03). Thus, the dispersion score for the advertisement set in this example is 0.33.

In some implementations, the dispersion score can be determined based on a weighted-sum of the differences between the relative conversion/click ratios and the advertisement set publication score. For example, the difference between the relative conversion/click ratio for each advertisement and the advertisement set publication score can be scaled by the percentage of total advertisement set clicks received by the advertisement. Similarly, the dispersion score for each advertisement set can be weighted by an amount of revenue provided by the advertisement set.

In some implementations, the publication evaluation subsystem 116 determines whether to assign an advertisement set publication score for an advertisement set based on whether the dispersion score for the advertisement set satisfies a dispersion score threshold. The dispersion score threshold can be defined as a maximum dispersion score that is acceptable for an advertisement set. The dispersion score threshold can be based on the dispersion score associated with the publication score of the publication. For example, the publication evaluation subsystem 116 can assign advertisement set publication scores to the publication when the dispersion score for the advertisement set is less than the dispersion score for the publication.

The publication evaluation subsystem 116 can assign additional advertisement set publication scores to a publication for additional advertisement sets that are identified for the publication. The publication evaluation subsystem 116 can identify additional advertisement sets that are independent of previously identified advertisement sets or advertisement sets that are sub-groups of previously identified advertisement sets. For example, a first advertisement set can be identified for advertisements related to sports and a second advertisement set can be identified for advertisements that are related to travel. Additionally, a third advertisement set can be identified for advertisements within the sports advertisement set that are related to football. Thus, multiple hierarchical levels of advertisement sets can be defined for a publication.

In some implementations, the publication evaluation subsystem 116 can limit the number of advertisement sets identified for a publication based on one or more stop conditions. A stop condition is a condition that indicates that additional advertisement sets and/or advertisement set scores should not be identified or generated for a publication. The stop condition can be defined based on a threshold number of hierarchical levels of advertisement sets for a publication. For example, the publication evaluation subsystem 116 can determine that the stop condition for a publication is satisfied when three hierarchical levels of advertisement sets and advertisement set publication scores are defined for the publication.

The stop condition can also be defined based on a minimum performance threshold being satisfied. The minimum performance threshold can be a minimum click or conversion threshold, a minimum revenue per click threshold, or some other performance based threshold (e.g., percentage improvement in dispersion score for a new advertisement set). For example, the publication evaluation subsystem 116 can determine that the stop condition is satisfied when the revenue for an advertisement set falls below $500 per week. When the stop condition is satisfied, the publication evaluation subsystem 116 can prevent the identification and/or generation of advertisement sets and/or advertisement set publication scores for the publication.

The performance of particular publications and advertisements can vary over time. Because the baseline performance measure is a relative measure of performance that is dependent on the performance of advertisements and publications, the publication scores for each publication may need adjustment to maintain the baseline performance measure as an accurate relative performance measure. For example, if the performance of some publications increases, the publication scores for these publications may not be comparable to publication scores that were generated several days earlier.

To counter the effects of performance variations over time, the publication evaluation subsystem 116 can periodically (e.g., weekly or daily) generate a normalization factor that can be applied to publication scores. In some implementations, the publication evaluation system 116 generates the normalization factor by determining a factor that maintains a relatively constant geometric mean (e.g., click-weighted sum) of publication scores for a sub-group of publications. For example, if the geometric mean of publication scores for a sub-group of publications changes by a factor of 1.2, the normalization factor can be defined as 1/1.2 so that the geometric mean remains relatively constant.

The sub-group of publications selected for monitoring performance variation can include a minimum number of publications such that there is a high likelihood that performance variations that occur throughout the content network are accounted for in the geometric mean of publication scores. The minimum number of publications can be, for example, a statistically relevant number of publications relative to the number of publications for which publication scores are generated. In some implementations, the minimum number of publications can be selected such that the sub-group of publications is representative of the population of publications.

Figure 2:
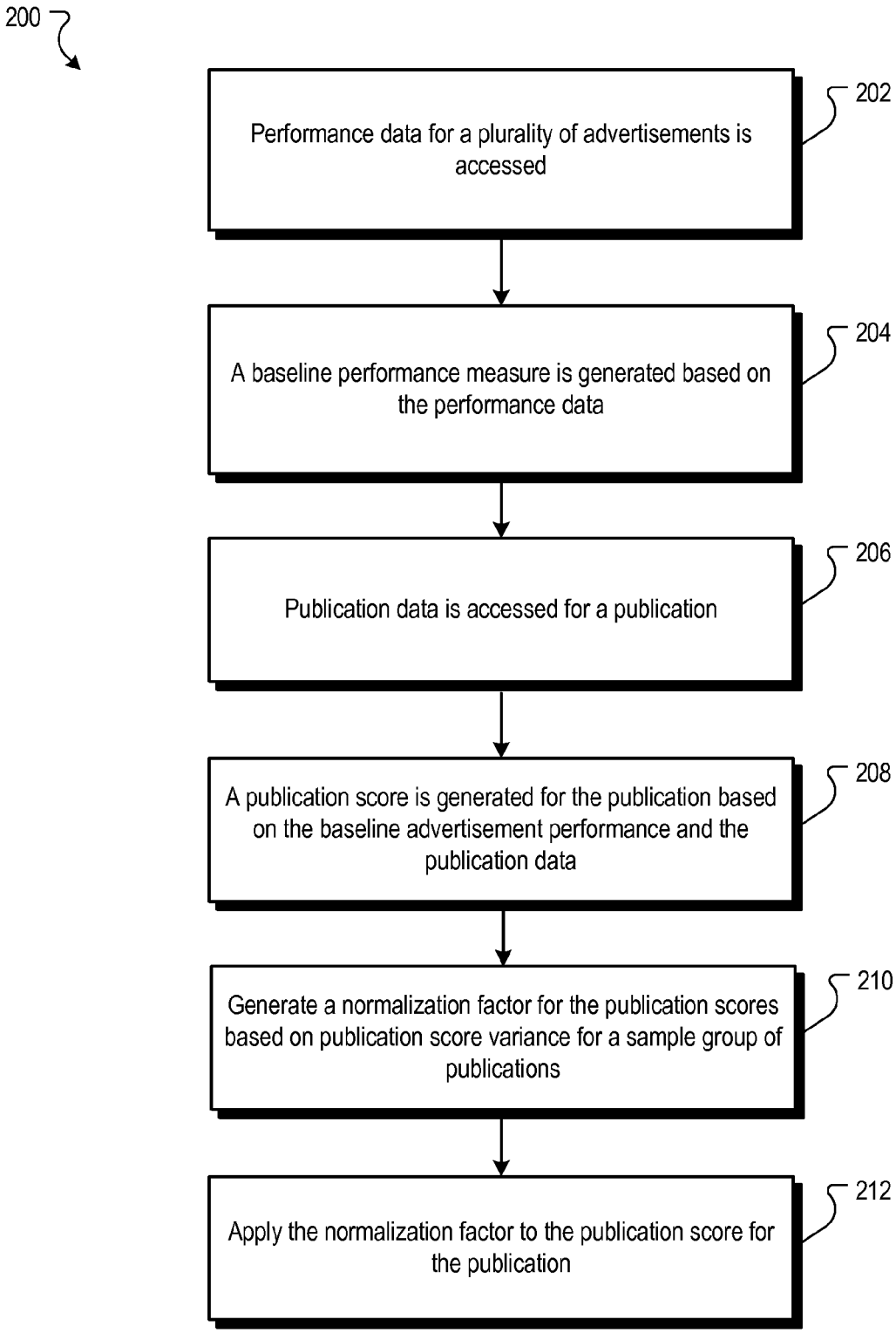
FIG. 2 is an example process for generating a publication score.

FIG. 2 is an example process 200 for generating a publication score. The process can be implemented, for example, by the publication evaluation subsystem 116.

As part of the process 200, performance data for a plurality of advertisements is accessed (202). In some implementations, the performance data for each advertisement specifies a performance measure for the advertisement. For example, performance data for an advertisement may specify a number of clicks per impression or a number of conversions per click. The performance data can be accessed, for example, from the performance data log 110.

A baseline performance measure is generated based on the performance data (204). In some implementations, the baseline performance measure specifies an expected performance for any advertisement irrespective of the publication with which the advertisement is presented. The baseline performance measure can be generated based on the performance data for the plurality of advertisements. For example, as described above, an aggregate performance of advertisements presented with publications in the content network can be defined as the baseline advertisement performance measure. Generation of the baseline performance measure is discussed in further detail with reference to FIG. 3.

Publication data is accessed for a publication (206). In some implementations, the publication data includes a performance measure for each advertisement that was presented with the publication. The performance measure for the publication is indicative of the performance of advertisements when presented with the publication. For example, the publication data may include conversion/click ratio for advertisements based on the advertisements being presented with the publication. The publication data can be accessed, for example, in the performance data 110.

A publication score is generated for the publication based on the baseline advertisement performance and the publication data (208). In some implementations, the publication score can be generated based on an aggregate of performance measures for advertisements presented with the publication relative to the baseline performance. For example, the publication score for a particular publication can be a ratio of the total number of conversions for the advertisements that are presented with the publication relative to a product of the baseline performance measure and the total clicks or selections of the advertisements.

In some implementations, the aggregate performance can be based, for example, on a maximum likelihood estimate of publication performance based on the publication data and the baseline performance measure.

Generate a normalization factor for the publication scores based on a publication score variance for a sample group of publications (210). In some implementations, the normalization factor is a multiplicative factor that will maintain a constant geometric mean of publication scores for the sample group of publications. The sample group of publications can be selected to be representative of the publications in the content network such that variations in publication scores for sub-groups of publications are accounted for in the geometric mean of publication scores for the sample group.

The normalization factor is applied to the publication score for the publication (212). In some implementations, the normalization factor is applied to each publication score that was generated for the one or more publications. The normalization factor can be applied to the publication score, for example, by determining a product of the publication score and the normalization factor.

Figure 3:
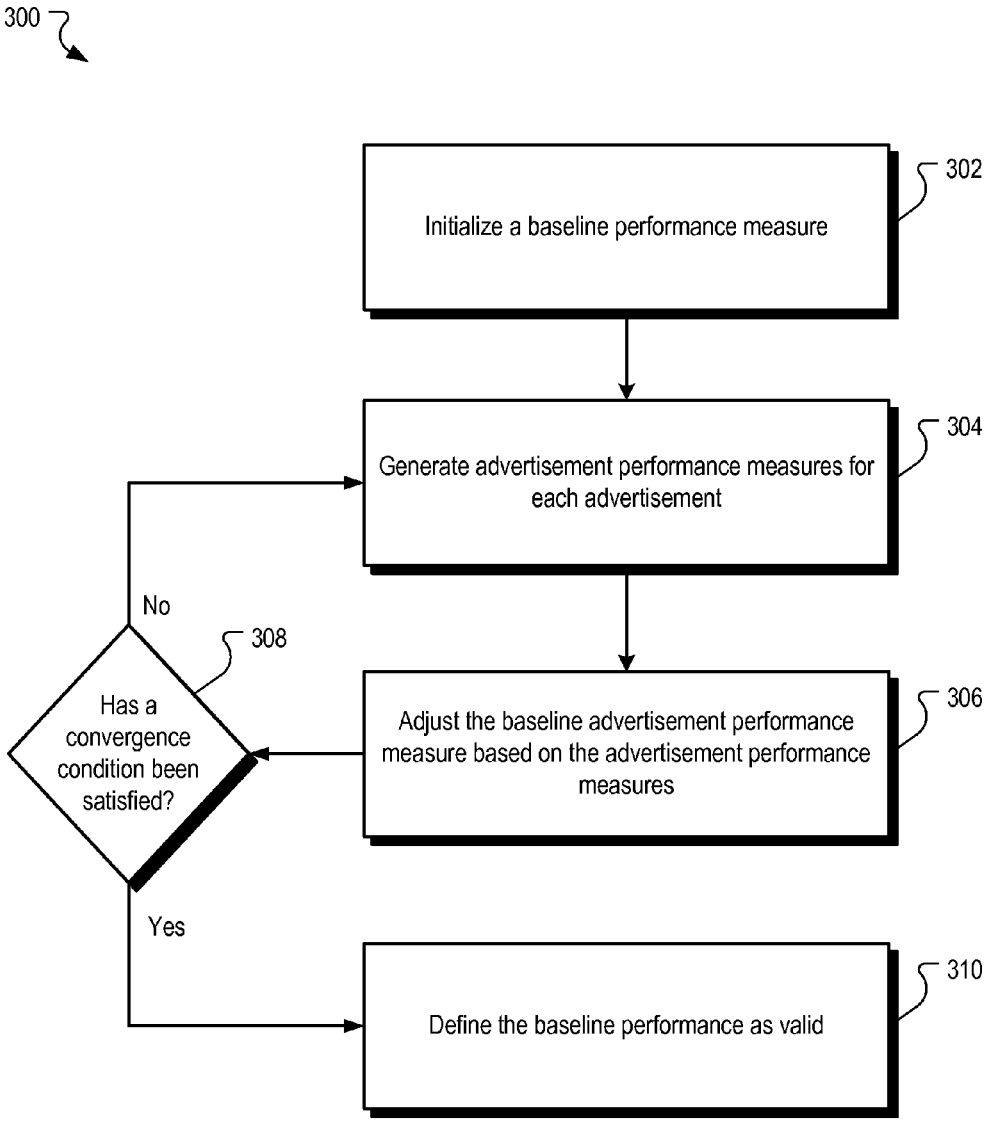
FIG. 3 is an example process for generating a baseline performance measure.

FIG. 3 is an example process 300 for generating a baseline performance measure. The process 300 can be implemented, for example, by the publication evaluation subsystem 116.

The baseline advertisement performance measure is initialized (302). In some implementations, the baseline advertisement performance can be initialized by setting the baseline advertisement performance to a default value. For example, the baseline advertisement performance can be initialized by setting the value of the baseline advertisement performance to be equal to the average conversion rate for each of the advertisements. The baseline advertisement performance can be initialized, for example, by the publication evaluation subsystem 116.

Advertisement performance measures are generated for each advertisement (304). In some implementations, the advertisement performance measure is generated based on a performance of the ad relative to the baseline performance. The advertisement performance measures of the plurality of advertisements can be represented, for example, as adscores, as discussed above.

In some implementations, the advertisement performance measures can be generated based on a maximum likelihood estimate of advertisement performance based on the performance of the ad and the initialized baseline performance. For example, the most likely performance measure for the advertisement given the baseline performance and the performance data of the advertisement can be computed.

The baseline advertisement performance measure is adjusted based on an aggregate of the advertisement performance measures (306). For example, a maximum likelihood estimate of an aggregate advertisement performance can be generated based on the advertisement performance measures, as described above.

A determination is made as to whether a convergence condition has been satisfied (308). In some implementations, the convergence condition is satisfied when the difference between the output baseline performance measure and the input baseline performance measure is less than a threshold difference.

If the convergence condition is not satisfied, advertisement performance measures are generated for the plurality of advertisements (304). However, if the convergence condition is satisfied, the baseline performance measure is defined as valid (310). A baseline performance measure that has been defined as valid can be used to generate a publication score, as described above.

Figure 4:
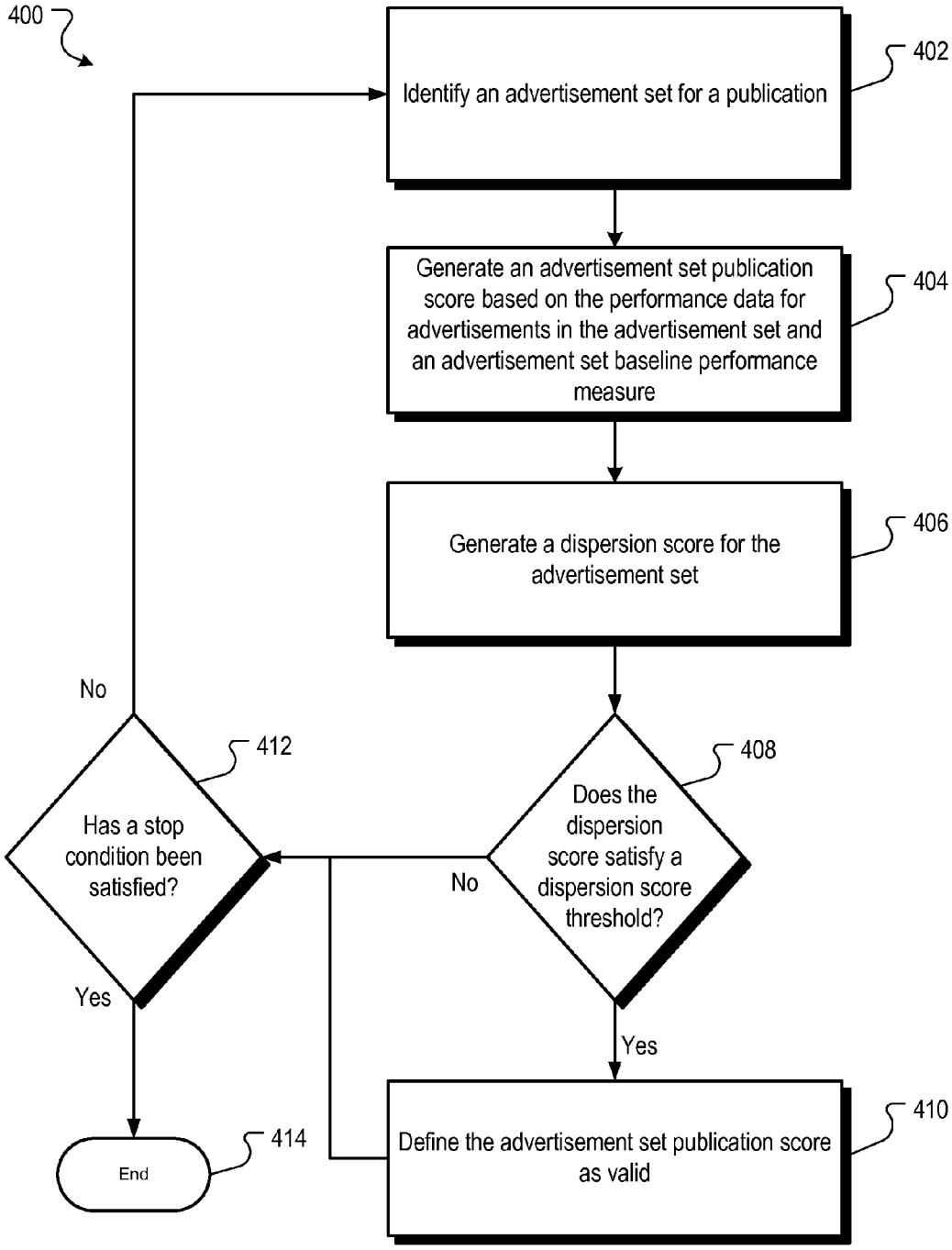
FIG. 4 is an example process for generating advertisement set publication scores.

FIG. 4 is an example process 400 for generating advertisement set publication scores. The process 400 can be implemented, for example, by the publication evaluation subsystem 116.

An advertisement set is identified for a publication (402). In some implementations, the advertisement set is identified based on a common characteristic of one or more advertisements that are presented with the publication. For example, if a group of advertisements that are presented with the publication are all in a common language (e.g., French), an advertisement set corresponding to the language can be identified for the publication.

The common characteristic of the one or more advertisements can be identified based on information provided by the advertiser. For example, an advertiser may provide information identifying a language of the advertisement, targeting criteria for the advertisement or other characteristics associated with the advertisement.

Similarly, the common characteristic of the one or more advertisements can be identified from content of the advertisement. For example, the content of an advertisement can be examined to determine a language of text in the advertisement. Similarly, words in the advertisement can be analyzed to determine the subject matter to which the advertisement is related. For example, if the word "football" is identified in an advertisement, the advertisement may be grouped in an advertisement set for advertisements related to sports or football.

An advertisement set publication score is generated based on the performance data for advertisements in the advertisement set and an advertisement set baseline performance measure (404). The advertisement set baseline performance measure is an expected performance measure for the advertisements in the advertisement set when presented with any publication. The advertisement set publication score is an expected performance measure for advertisements in the advertisement set when presented with the publication.

A dispersion score is generated for the advertisement set (406). In some implementations, the dispersion score is indicative of performance variance for advertisements in the advertisement set relative to the advertisement set publication score. The dispersion score for an advertisement set can be a sum of performance variances for each advertisement in the advertisement set relative to the advertisement set publication score.

For example, a first advertisement in an advertisement set can have a relative conversion/click measure (i.e., (conversion/click on publication)/(baseline conversion/click) of 0.45 while a second advertisement in the advertisement set can have a relative conversion/click measure of 0.55. Assuming that the advertisement set publication score is 0.5 and that these are the only advertisements in the advertisement set, the dispersion score for the advertisement set is 0.1 (i.e., 0.05+0.05). In some implementations, the values of each of the variances can be weighted based on the percentage of total clicks that each advertisement received.

A determination is made whether the dispersion score satisfies a dispersion score threshold (408). In some implementations, the dispersion score threshold is a maximum acceptable dispersion score for an advertisement set. Therefore, the dispersion score threshold can be satisfied by a dispersion score that is less than or equal to the dispersion score threshold.

The advertisement set publication score for the advertisement set is defined as valid when the dispersion score for the advertisement set satisfies the dispersion score threshold (410). When an advertisement set publication score is defined as valid, the advertisement set publication score can be applied to a bid (e.g., a price paid for presentation of the advertisement) associated with an advertisement that is included in the advertisement set to adjust a price paid by the advertiser to account for the quality of the publication. The advertisement set publication score can be applied to the bid, for example, by determining a product of the advertisement set publication score and the bid.

A determination is made whether a stop condition has been satisfied (412). The determination can be made, for example, when the dispersion score does not satisfy the dispersion score threshold or when an advertisement set publication score is defined as valid. The stop condition is a condition indicating that additional advertisement set publication scores should not be generated for a publication. The stop condition can be satisfied based on various advertisement set measures. For example, the stop condition can be satisfied by a threshold number of advertisement sets being defined or advertisement set performance (e.g., revenue, clicks and/or conversions) falling below a threshold. When the stop condition is not satisfied, another advertisement set is identified for the publication (402). However, when the stop condition is satisfied, the process ends (414).

Figure 5:
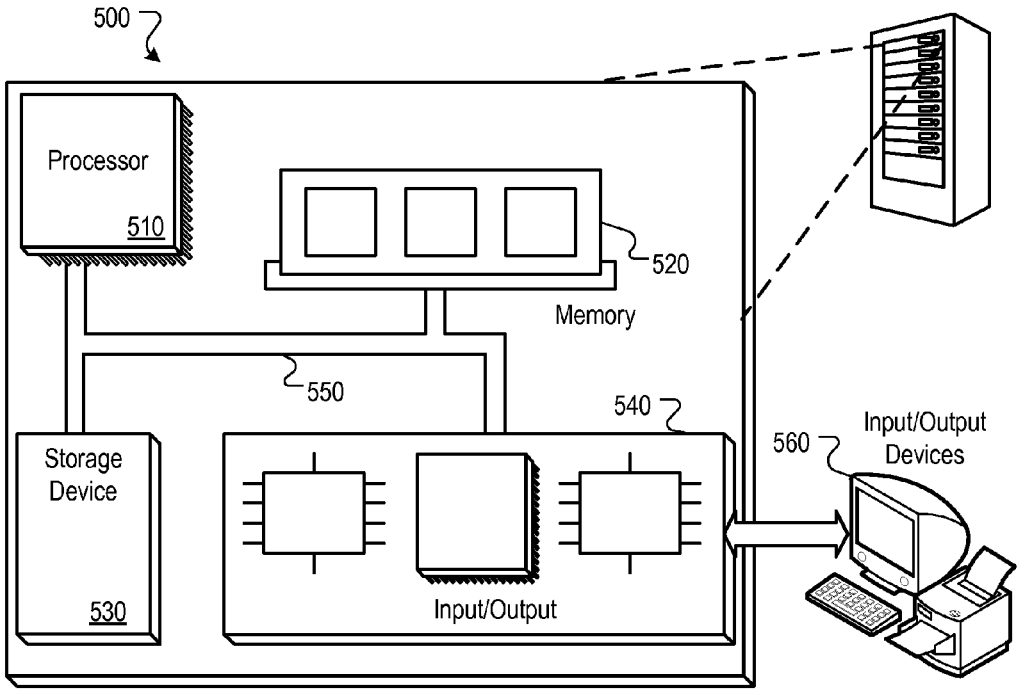
FIG. 5 is block diagram of an example computer system that can be used to evaluate publications.

FIG. 5 is block diagram of an example computer system 500 that can be used to evaluate publications. The system 500 includes a processor 510, a memory 520, a storage device 530, and an input/output device 540. Each of the components 510, 520, 530, and 540 can be interconnected, for example, using a system bus 550. The processor 510 is capable of processing instructions for execution within the system 500. In one implementation, the processor 510 is a single-threaded processor. In another implementation, the processor 510 is a multi-threaded processor. The processor 510 is capable of processing instructions stored in the memory 520 or on the storage device 530.

The memory 520 stores information within the system 500. In one implementation, the memory 520 is a computer-readable medium. In one implementation, the memory 520 is a volatile memory unit. In another implementation, the memory 520 is a non-volatile memory unit.

The storage device 530 is capable of providing mass storage for the system 500. In one implementation, the storage device 530 is a computer-readable medium. In various different implementations, the storage device 530 can include, for example, a hard disk device, an optical disk device, or some other large capacity storage device.

The input/output device 540 provides input/output operations for the system 500. In one implementation, the input/output device 540 can include one or more of a network interface devices, e.g., an Ethernet card, a serial communication device, e.g., and RS-232 port, and/or a wireless interface device, e.g., and 802.11 card. In another implementation, the input/output device can include driver devices configured to receive input data and send output data to other input/output devices, e.g., keyboard, printer and display devices 560. Other implementations, however, can also be used, such as mobile computing devices, mobile communication devices, and set-top box television client devices.

The publication evaluation subsystem 116 and/or advertisement management system 104 can be realized by instructions that upon execution cause one or more processing devices to carry out the processes and functions described above. Such instructions can comprise, for example, interpreted instructions, such as script instructions, e.g., JavaScript or ECMAScript instructions, or executable code, or other instructions stored in a computer readable medium. The publication evaluation subsystem 116 and/or advertisement management system 104 can be distributively implemented over a network, such as a server farm, or can be implemented in a single computer device.

Although an example processing system has been described in FIG. 5, implementations of the subject matter and the functional operations described in this specification can be implemented in other types of digital electronic circuitry, or in computer software, firmware, or hardware, including the structures disclosed in this specification and their structural equivalents, or in combinations of one or more of them. Implementations of the subject matter described in this specification can be implemented as one or more computer program products, i.e., one or more modules of computer program instructions encoded on a tangible program carrier for execution by, or to control the operation of, a processing system. The computer readable medium can be a machine readable storage device, a machine readable storage substrate, a memory device, a composition of matter effecting a machine readable propagated signal, or a combination of one or more of them.

The term "processing system," "processing devices" and "subsystem" encompasses all apparatus, devices, and machines for processing data, including by way of example a programmable processor, a computer, or multiple processors or computers. The processing system can include, in addition to hardware, code that creates an execution environment for the computer program in question, e.g., code that constitutes processor firmware, a protocol stack, a database management system, an operating system, or a combination of one or more of them.

A computer program (also known as a program, software, software application, script, or code) can be written in any form of programming language, including compiled or interpreted languages, or declarative or procedural languages, and it can be deployed in any form, including as a stand alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

Computer readable media suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD ROM disks. The processor and the memory can be supplemented by, or incorporated in, special purpose logic circuitry.

Implementations of the subject matter and the functional operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer program products, i.e., one or more modules of computer program instructions encoded on a tangible program carrier for execution by, or to control the operation of, data processing apparatus.

Implementations of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Particular implementations have been described. Other implementations are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous. While reference is made to delivering advertisements, other forms of content including other forms of sponsored content can be delivered.

This written description sets forth the best mode of the invention and provides examples to describe the invention and to enable a person of ordinary skill in the art to make and use the invention. This written description does not limit the invention to the precise terms set forth. Thus, while the invention has been described in detail with reference to the examples set forth above, those of ordinary skill in the art may effect alterations, modifications and variations to the examples without departing from the scope of the invention.

What is claimed is:

1. A computer-implemented method, comprising:

accessing, by one or more computers, for each advertisement of a plurality of advertisements, a first advertisement score, the first advertisement score for each particular advertisement being based on a performance measure for the particular advertisement independent of a publication with which the particular advertisement was presented;

generating, by the one or more computers, a baseline performance measure for the plurality of advertisements based on the first advertisement scores, the baseline performance measure being a publication independent value that indicates an aggregate performance of the plurality of advertisements;

accessing, by the one or more computers, first publication data corresponding to a first set of advertisements that were presented with a first publication, the first set of advertisements being a subset including at least two or more of the plurality of advertisements, and the first publication data including:

i) the first advertisement score for each advertisement in the first set of advertisements; and ii) first publication performance measures for each advertisement in the first set of advertisements, the first publication performance measures indicating, for each advertisement in the first set of advertisements, a performance measure for the advertisement when presented with the first publication;

generating, by the one or more computers, a publication score for the first publication based on a function of the baseline performance measure, the first advertisement score for each advertisement in the first set of advertisements, and the first publication performance measures for each advertisement in the first set of advertisements;

generating, by the one or more computers, an updated advertisement score for each particular advertisement in the first set of advertisements, the updated advertisement score being a publication-dependent measure of performance for the advertisement and is dependent on at least one publication score for publications with which the advertisement has been presented, and each updated advertisement score being generated for each advertisement in the first set of advertisements based on a function of the publication score for the first publication and the first advertisement score for the advertisement; and generating, by the one or more computers, a publication score for a second publication based on second publication data corresponding to a second set of advertisements that were presented with the second publication, the second set of advertisements being a subset of the plurality of advertisements and including one or more of the advertisements from the first set of advertisements, wherein the publication score for the second publication is generated based on a function of the baseline performance measure, first advertisement scores for advertisements, other than the advertisements from the first set of advertisements, that are in the second set of advertisements, updated advertisement scores for advertisements that are in both the first and second set of advertisements, and second publication performance measures for each advertisement in the second set of advertisements, the second publication performance measures indicating, for each advertisement in the second set of advertisements, a performance measure for the advertisement when presented with the second publication.

2. The method of claim 1, further comprising:

adjusting a price paid for presentation of an advertisement with a publication based on the publication score for the publication.

3. The method of claim 1, further comprising:

identifying one or more related advertisement sets for a publication, each related advertisement set including one or more advertisements that each have a common characteristic; and for each related advertisement set:

generating a related advertisement set publication score based on the updated advertisement scores for advertisements in the related advertisement set and a related advertisement set baseline performance measure; and adjusting a price paid for presentation of an advertisement in the related advertisement set based on the related advertisement set publication score.

4. The method of claim 3, further comprising:

generating a dispersion score for each related advertisement set, the dispersion score representing a variance of advertisement performance relative to the related advertisement set publication score;

determining whether the dispersion score satisfies a dispersion score threshold; and wherein the adjusting is conditioned on the dispersion score satisfying a dispersion score threshold.

5. The method of claim 4, further comprising:

determining whether a stop condition has been satisfied; and wherein identification of one or more related advertisement sets is conditioned on the stop condition not being satisfied.

6. The method of claim 1, wherein generating a baseline performance measure comprises:

initializing the baseline performance measure to a default value;

for each advertisement, generating an advertisement performance measure for the advertisement based on a performance of the advertisement in response to presentation of the advertisement with the first publication relative to the baseline performance measure; and adjusting the baseline performance measure based on the advertisement performance measures.

7. The method of claim 6, further comprising:

determining whether a convergence condition has been satisfied; and in response to the convergence condition not being satisfied, iteratively generating the advertisement performance measures and the baseline performance measure until the convergence condition is satisfied.

8. The method of claim 7, further comprising:

defining the baseline performance as valid when the convergence condition is satisfied.

9. The method of claim 1, wherein the publication score for the first publication is indicative of an aggregate of the first publication performance measures relative to the baseline performance measure.

10. The method of claim 9, wherein generating a publication score for the first publication comprises generating a maximum likelihood estimate of first publication performance based on the first publication data.

11. The method of claim 1, wherein the performance measure comprises a conversion rate per advertisement selection.

12. The method of claim 1, further comprising:

generating a normalization factor for the publication scores based on publication score variance for a sample group of publications; and for each of one or more publications, applying the normalization factor to the publication score.

13. A system, comprising:

an advertisement management system comprising one or more processors that receives advertisement targeting data from advertisers and provides advertisements with publications in response to a request for an advertisement, the advertisements being provided with publications that include content that satisfy the advertisement targeting data;

a data store coupled to the advertisement management system to store the advertisement targeting data, advertisement performance data and publication performance data; and a publication evaluation subsystem comprising one or more processors, the publication evaluation subsystem being coupled to the advertisement management system and the data store, the publication evaluation subsystem operable to perform operations including:

accessing, for each advertisement of a plurality of advertisements, a first advertisement score, the first advertisement score for each particular advertisement being based on a performance measure for the particular advertisement independent of a publication with which the particular advertisement was presented;

generating a baseline performance measure for the plurality of advertisements based on the first advertisement scores, the baseline performance measure being a publication independent value that indicates an aggregate performance of the plurality of advertisements;

accessing first publication data corresponding to a first set of advertisements that were presented with a first publication, the first set of advertisements being a subset including at least two or more of the plurality of advertisements, and the first publication data including:

i) the first advertisement score for each advertisement in the first set of advertisements; and ii) first publication performance measures for each advertisement in the first set of advertisements, the first publication performance measures indicating, for each advertisement in the first set of advertisements, a performance measure for the advertisement when presented with the first publication;

generating a publication score for the first publication based on a function of the baseline performance measure, the first advertisement score for each advertisement in the first set of advertisements, and the first publication performance measures for each advertisement in the first set of advertisements;

generating an updated advertisement score for each particular advertisement in the first set of advertisements, the updated advertisement score being a publication-dependent measure of performance for the advertisement and is dependent on at least one publication score for publications with which the advertisement has been presented, and each updated advertisement score being generated for each advertisement in the first set of advertisements based on a function of the publication score for the first publication and the first advertisement score for the advertisement; and generating a publication score for a second publication based on second publication data corresponding to a second set of advertisements that were presented with the second publication, the second set of advertisements being a subset of the plurality of advertisements and including one or more of the advertisements from the first set of advertisements, wherein the publication score for the second publication is generated based on a function of the baseline performance measure, first advertisement scores for advertisements, other than the advertisements from the first set of advertisements, that are in the second set of advertisements, updated advertisement scores for advertisements that are in both the first and second set of advertisements, and second publication performance measures for each advertisement in the second set of advertisements, the second publication performance measures indicating, for each advertisement in the second set of advertisements, a performance measure for the advertisement when presented with the second publication.

14. The system of claim 13, wherein the publication evaluation subsystem is further operable to adjust a price paid by an advertiser for presentation of an advertisement with the publication based on the publication score.

15. The system of claim 13, wherein the advertisement targeting data specifies criteria that a publication should satisfy for an advertisement to be presented with the publication.

16. The system of claim 15, wherein the criteria includes at least one content-based targeting criterion.

17. The system of claim 13, wherein the publication evaluation subsystem is further operable to generate a related advertisement set publication score based on the updated advertisement scores for advertisements in the related advertisement set, each related advertisement set including one or more advertisements that each have a common characteristic.

18. The system of claim 17 wherein the publication evaluation subsystem is further operable to generate a dispersion score for each related advertisement set, the dispersion score representing a variance of advertisement performance relative to the related advertisement set publication score and determine whether the dispersion score satisfies a dispersion score threshold.

19. The system of claim 13, wherein the publication evaluation subsystem generates the baseline performance measure by:

initializing the baseline performance measure to a default value;

for each advertisement, generating an advertisement performance measure for the advertisement based on a performance of the advertisement in response to presentation of the advertisement with the first publication relative to the baseline performance measure; and adjusting the baseline performance measure based on the advertisement performance measures.

20. A non-transitory computer readable media comprising instructions that upon execution by one or more computers, cause the one or more computers to perform operations comprising:

accessing, for each advertisement of a plurality of advertisements, a first advertisement score, the first advertisement score for each particular advertisement being based on a performance measure for the particular advertisement independent of a publication with which the particular advertisement was presented;

generating a baseline performance measure for the plurality of advertisements based on the first advertisement scores, the baseline performance measure being a publication independent value that indicates an aggregate performance of the plurality of advertisements;

accessing first publication data corresponding to a first set of advertisements that were presented with a first publication, the first set of advertisements being a subset including at least two or more of the plurality of advertisements, and the first publication data including;

i) the first advertisement score for each advertisement in the first set of advertisements; and ii) first publication performance measures for each advertisement in the first set of advertisements, the first publication performance measures indicating, for each advertisement in the first set of advertisements, a performance measure for the advertisement when presented with the first publication;

generating a publication score for the first publication based on a function of the baseline performance measure, the first advertisement score for each advertisement in the first set of advertisements, and the first publication performance measures for each advertisement in the first set of advertisements;

generating an updated advertisement score for each particular advertisement in the first set of advertisements, the updated advertisement score being a publication-dependent measure of performance for the advertisement and is dependent on at least one publication score for publications with which the advertisement has been resented and each updated advertisement score being generated for each advertisement in the first set of advertisements based on a function of the publication score for the first publication and the first advertisement score for the advertisement; and generating a publication score for a second publication based on second publication data corresponding to a second set of advertisements that were presented with the second publication, the second set of advertisements being a subset of the plurality of advertisements and including one or more of the advertisements from the first set of advertisements, wherein the publication score for the second publication is generated based on a function of the baseline performance measure, first advertisement scores for advertisements, other than the advertisements from the first set of advertisements, that are in the second set of advertisements, updated advertisement scores for advertisements that are in both the first and second set of advertisements, and second publication performance measures for each advertisement in the second set of advertisements, the second publication performance measures indicating, for each advertisement in the second set of advertisements, a performance measure for the advertisement when presented with the second publication.

* * * * *

UNITED STATES PATENT AND TRADEMARK OFFICE

CERTIFICATE OF CORRECTION

PATENT NO. : 8,543,453 B1
APPLICATION NO. : 12/437705
DATED : September 24, 2013
INVENTOR(S) : Guy Calvert et al.

It is certified that error appears in the above-identified patent and that said Letters Patent is hereby corrected as shown below:

In the Claims:

In Claim 20, Column 23, Line 9, delete “resented” and insert -- presented, --, therefor.

Signed and Sealed this
Twenty-eighth Day of January, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,543,453 B1
APPLICATION NO. : 12/437705
DATED : September 24, 2013
INVENTOR(S) : Calvert et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 714 days.

Signed and Sealed this
Tenth Day of March, 2015

Michelle K. Lee

Michelle K. Lee
*Deputy Director of the United States Patent and Trademark Office*